United States Patent [19]

Hampson

[11] Patent Number: 4,534,083

[45] Date of Patent: Aug. 13, 1985

[54] CONTROL VALVE ASSEMBLY

[75] Inventor: Herbert Hampson, Grafton, Ohio

[73] Assignee: Hampson Enterprises, Inc., Elyria, Ohio

[21] Appl. No.: 464,360

[22] Filed: Feb. 7, 1983

[51] Int. Cl.[3] ..... A47L 11/34

[52] U.S. Cl. ..... 15/321; 137/892

[58] Field of Search ..... 15/320, 321, 322; 137/892, 895

[56] References Cited

U.S. PATENT DOCUMENTS

| | | | |
|---|---|---|---|
| 3,176,716 | 4/1965 | Bucknell et al. | 137/892 X |
| 3,705,437 | 12/1972 | Rukavina et al. | 15/322 X |
| 3,747,155 | 7/1973 | Koellisch | 15/322 |
| 3,933,179 | 1/1976 | Hechler | 137/895 X |
| 3,974,541 | 8/1976 | Silvis et al. | 15/322 X |
| 4,207,649 | 6/1980 | Bates | 15/321 X |
| 4,333,203 | 6/1982 | Yonkers | 15/322 X |

*Primary Examiner*—Chris K. Moore

*Attorney, Agent, or Firm*—Baldwin, Egan & Fetzer

[57] ABSTRACT

A control valve for variably controlling the mixing and dispensing of two fluids and which valve has a primary valve and a slave valve interconnected to the primary valve and responsive to one of the fluids to actuate the primary and slave valves to either a valve closed or valve open position whereat in the latter position the mixture and dispensing of both fluids is accomplished.

2 Claims, 5 Drawing Figures

CONTROL VALVE ASSEMBLY

DESCRIPTION

Technical Field

This invention relates to a new and novel control valve assembly especially designed to variably control the dispensing of a mixture of two fluids. In its present structural configuration the present control valve assembly is intended to be operable with a wet-dry vacuum cleaner for cleaning floors and various fabrics such as carpets, upholstery and the like; however as will hereinafter be apparent, the valve assembly of the present invention may have utility in other environments of use for variably controlling dispensing a mixture of two fluids.

BACKGROUND AND SUMMARY OF THE INVENTION

Typical of prior control valve assemblies for dispensing a mixture of two fluids, particularly in the environment of wet-dry vacuum cleaners and the like is disclosed in U.S. Pat. No. 4,333,203 wherein the valve assembly comprises an elongated tubular valve member that is slidably movable in a valve body which is connectable to two separate fluid sources and which valve member is manually operable to a plurality of positions within the body effective to cause the mixing of the two fluids and dispensing of said mixture to the cleaning head or wand of the vacuum cleaner.

Another distinction represented by the present valve assembly is that the valve comprises a unique combination of a pilot valve element and a slave valve element which cooperatively function to control the mixing and dispensing of two fluids.

Other advantages of the valve assembly of the present invention will become apparent to one skilled in the art to which it relates, and upon reference to the following description of a preferred embodiment which is illustrated in the following identified drawings, wherein:

DESCRIPTION OF PREFERRED EMBODIMENT

Figure 1:
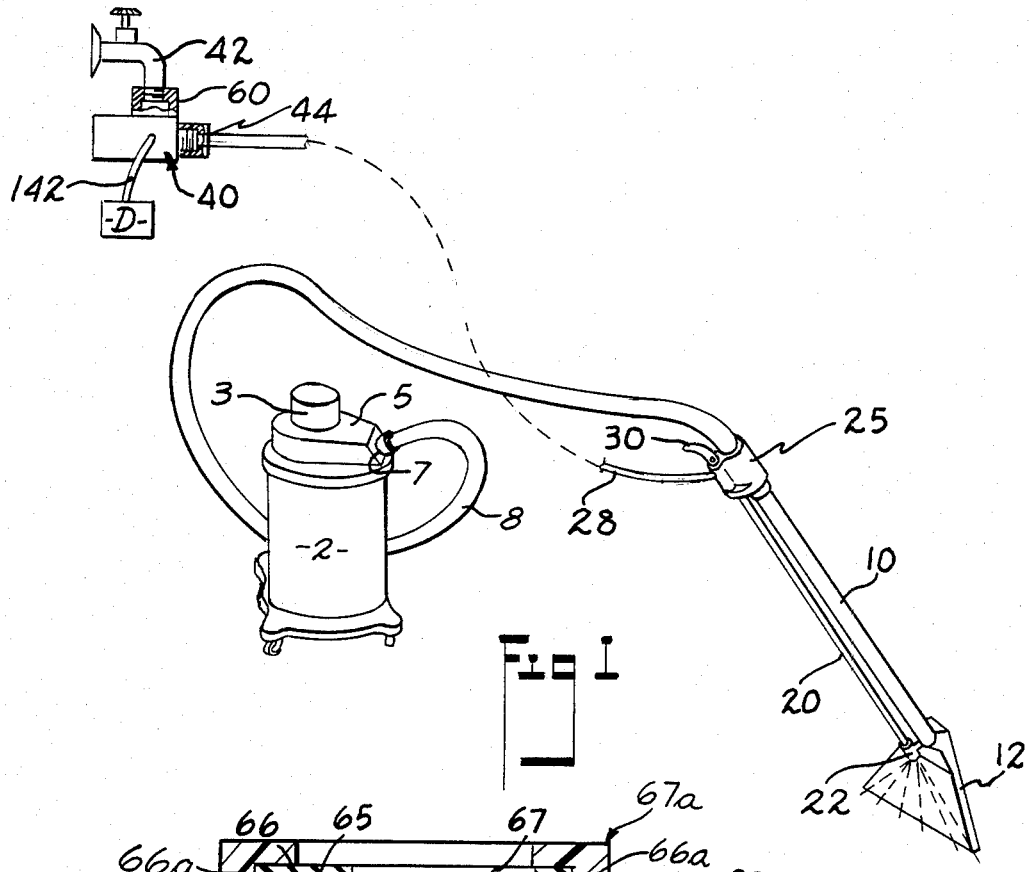
FIG. 1 is a perspective view of a typical wet-dry vacuum cleaner, and illustrating the valve assembly of the present invention interconnected between a domestic source of water and the wand unit of the vacuum cleaner.

A typical wet-dry vacuum cleaner is identified at 1 in FIG. 1 and comprises a portable tank 2 mounting a vacuum pump 3 on its top cover 5, which pump is intended to be connected to a suitable electrical power source. A vacuum inlet 7 is provided in the side wall of the cover 5 to which one end of flexible hose 8 is attached. The opposite end of said hose 8 connects to the upper end of wand 10, and the opposite end of the wand 10 mounts a fan-shaped cleaning head 12.

In use, with the vacuum pump 3 energized suction is provided to the cleaning head 12 sufficient to draw the cleaning fluid and the dirt suspended therein up out of the carpet as the head is pulled therealong.

A tube 20 suitable mounted to and extending along the wand 10 is provided with an outlet nozzle 22 at its lower end which is disposed in front of and closely adjacent the cleaning head 12.

The opposite end of said tube 20 is connected to the outlet of a conventional on-off valve 25. The input port of valve 25 connects to one end of pipe 28. Valve 25 is provided with a finger type control lever 30 which is intended to be actuated by the operator selectively to either valve closed or valve open position.

Figure 2:
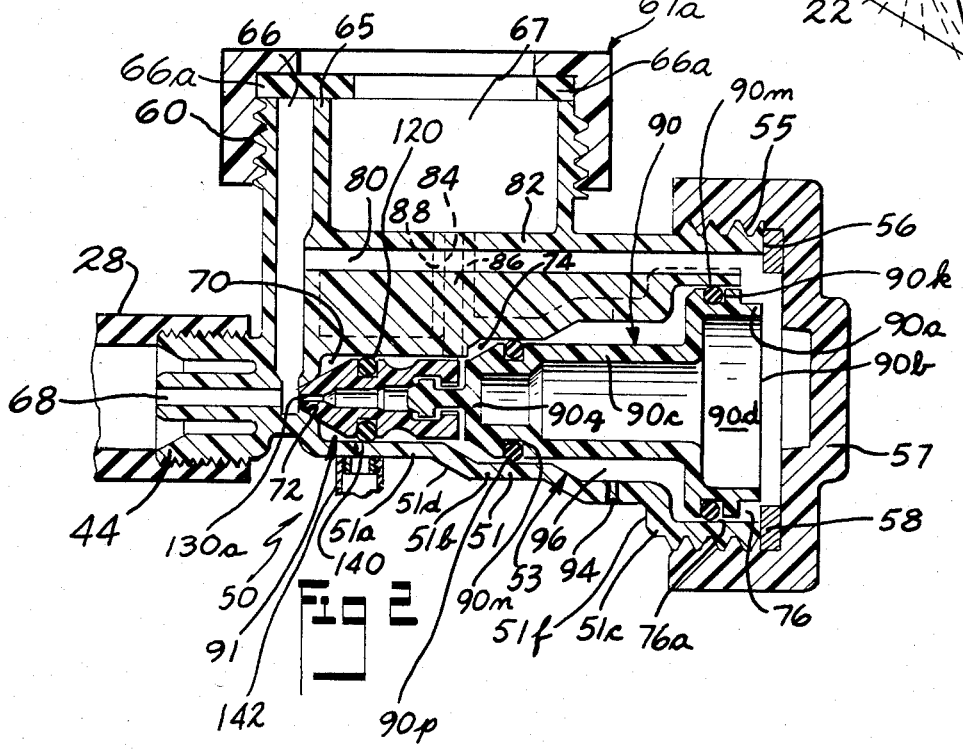
FIG. 2 is a longitudinal section view of the valve assembly in the closed valve position.

The valve assembly of the present invention as illustrated at 40, may be attached to a suitable source of domestic water such as at faucet 42, and the opposite end of the pipe 28 is connected to the outlet boss 44 of the valve assembly as best seen in FIG. 2.

With the faucet 42 and valve 25 turned on, the valve assembly 40 is intended to variably control the mixing and dispensing of a suitable liquid cleaning detergent D and water through the pipe 28, tube 20 and nozzle 22 to the carpet or other material to be cleaned whereafter the suction created by pump 3 sucks this cleaning solution along with the removed dirt into the tank 2.

For this purpose, as seen in FIG. 2, valve assembly is depicted in its entirety at 50 and comprises an elongate body 51 of irregular configuration integrally formed on its left end with the aforementioned exteriorly threaded outlet boss 44 to which one end of the pipe 28 is attached.

As seen in FIG. 2, the valve body 51 in its longitudinal extension is of stepped configuration as defined by the adjoining body sections 51*a*, 51*b* and 51*c*. Body sections 51*a*, 51*b* and 51*c* are in longitudinal alignment and define an interior valve chamber 53 of corresponding stepped longitudinal contour. Body section 51*c*, as seen in FIG. 2 is disposed at the right end and is exteriorly threaded at 55 at the open end 56 thereof. An end cap 57 is threaded onto said open end 56 is effective to close the same. A suitable seal 58 interposed between the open end 56 of said body and the cap 57 is intended to provide a fluid seal therebetween.

As seen in FIG. 2, an exteriorly threaded boss or flange 60 open at its top end is formed integrally with valve body 51 and projects radially outwardly therefrom, closely adjacent the threaded outlet 44.

The interior of said boss 60 is divided by wall 65 into two chambers 66 and 67. Boss 60 is intended to be suitably fastened by threaded coupling 67*a* to a source of water such as the conventional faucet 42 of a domestic water source to connect said source to chamber 67. Seal 66*a* interposed between the upper edge of boss 60 and the coupling 67*a* seals the upper end of chamber 66.

Figure 3:
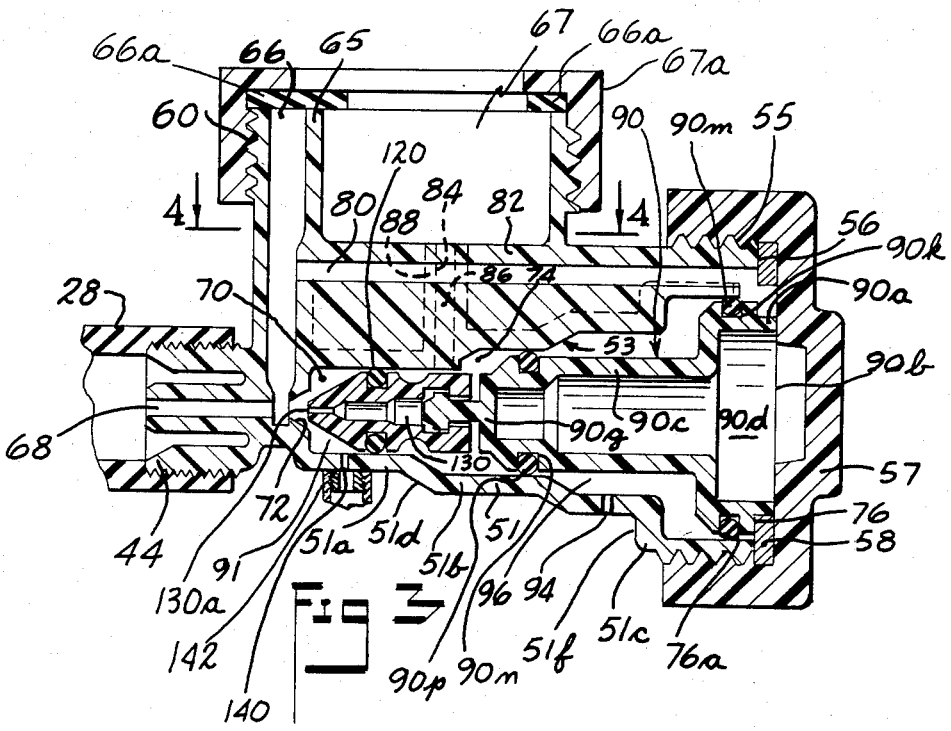
FIG. 3 is a longitudinal sectional view of the valve assembly in the open valve position.

As best seen in FIGS. 2 and 3, the chamber 66 projects into valve body section 51*a* and communicates at its inner end with one end of a channel 68 extending longitudinally centrally through said outlet boss 44 and opening to the left end thereof.

The valve body section 51*a* is provided with a centrally disposed chamber 70 which communicates at its left end through annular valve seat 72 to the lower terminus of chamber 66.

The adjoining valve body sections 51*a* and 51*b* are integrally connected by outwardly projecting angular wall 51*d* to thus define a correspondingly enlarged interior chamber 74 which communicates at its one end with chamber 70 and projects longitudinally therefrom to the right as viewed in FIG. 2. In like manner, valve body sections 51*b* and 51*c* are interconnected by transverse wall 51*f* to define a relatively enlarged interior chamber 76 which connects at its left end to chamber 74. As aforementioned, cap member 57 encloses the right end of the valve body 51, as viewed in FIG. 2, thus closing the right end of chamber 76.

A channel 80 is formed in the valve body 51, as viewed in FIG. 2, and extends longitudinally therethrough in spaced relation to the central axis thereof and connects at its left end with chamber 66 and at its right end with chamber 76.

The valve body 51 is provided with a base wall 82 as also seen in FIG. 2, which forms the bottom of the chamber 67 in the boss 60.

A port 84, FIG. 2, is formed in the boss wall 82 and connects with the upper end of channel 86 formed centrally in radially projecting column 88; said channel 86 extending through said column 88 and connecting at its lower end with valve chamber 74.

As will be seen in FIGS. 2 and 3, port 84 and connecting channel 86 are separate from longitudinally extending channel 80.

A composite valve member is disposed within valve chambers 70. 74 and 76, and as best seen in FIG. 2, said valve member comprises a pilot valve 90 and a slave valve 91 interconnected to each other in relative longitudinal extension to each other. Said valve member, as aforesaid, is automatically actuatable to variably control the mixing and dispensing of the two aforementioned fluids, i.e. detergent and water as used in the present environment.

Figure 4:
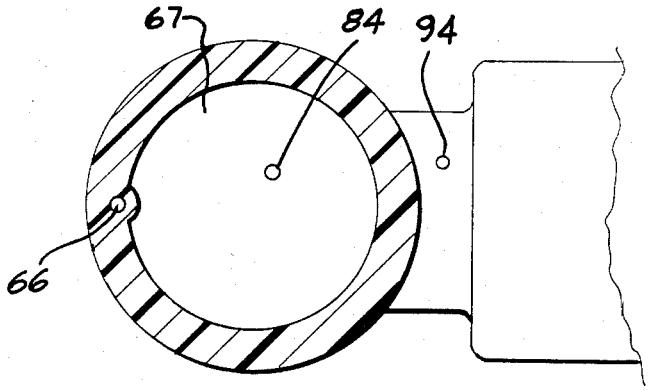
FIG. 4 is a sectional view taken on line 4—4 of FIG. 3.

As best seen in FIG. 4, the pilot valve member 90 is generally of cylindrical stepped configuration having a relatively large cylindrical part 90*a* on its right end which is open on said end at 90*b* to the chamber 76, as seen in FIGS. 2 and 3. An intermediate cylindrical part 90*c* of somewhat lesser diameter adjoins part 90*a* to define an interior cavity 90*d* of corresponding configuration communicating through open end 90*b* to said chamber 76. As seen in FIGS. 2 and 3, the cavity 90*d* is closed on its left end at transverse end wall 90*g* which is circular in configuration.

The exterior wall of cylindrical part 90*a* is provided with a groove 90*k* into which is disposed a suitable seal such as O-ring 90*m* which is intended to sealingly engage the wall 76*a* defining chamber 76 to thus seal said chamber from the interior of said valve body 51*c* to the left of said O-ring 90*m*, as viewed in FIG. 2. In like manner, the exterior wall of cylindrical part 90*c* is provided with groove 90*n* into which is disposed O-ring 90*p* and which sealingly engages the interior wall surface of valve body part 51*b*.

A vent or port 94 is provided in the wall part 51*b* to vent to atmosphere the chamber 96 formed by and between O-rings 90*m* and 90*p*.

Figure 5:
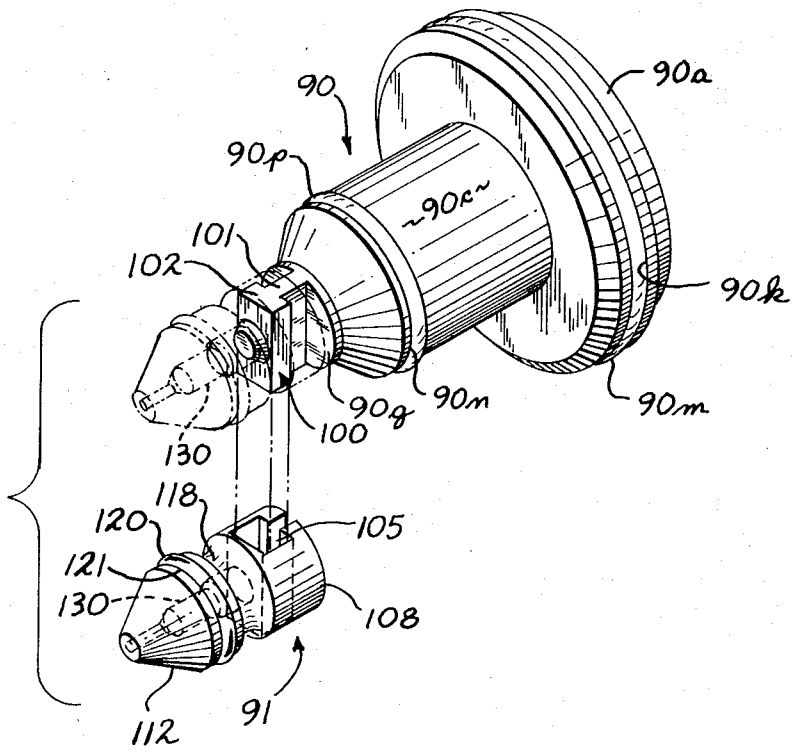
FIG. 5 is a perspective view of the pilot valve element - slave valve element assembly.

A T-shaped coupling member 100, FIG. 5, is formed on the outer face of end wall 90*g*, and as seen in FIG. 5, said coupling member 100 is generally rectangular in configuration and has its stem part 101 projecting centrally and perpendicularly outwardly from said end wall 90*g*. The cross bar or head 102 of said coupling member is so disposed as to be perpendicular to the longitudinal axis of said valve body The cross bar or head 102 of said coupling member 100 is disposed within a rectangular T-shaped cavity 105 formed in the right end cylindrical portion 108 of slave valve member 91. As best seen in FIGS. 2, 3 and 5 cavity 105 is intended to be slightly larger in its dimensional configuration to permit the head 102 of said coupling member 100 to freely slide into said cavity and to permit a slight amount of movement between said coupling and said slave valve member 91 .

Also as will be later explained, the dimensions of cavity 105 and the cross bar or head 102 are such as to permit liquid to flow therebetween.

As best seen in FIGS. 2, 3 and 5, the slave valve member 91 is generally bullet-shaped in its overall configuration having a conical forward part 112 and a rearwardly disposed cylindrical part 108 into which is formed the aforementioned cavity 105, said forward and rear parts being interconnected by an intermediate necked-down cylindrical part 118.

As best seen in FIGS. 2 and 3, slave valve member 91 is disposed within valve body chamber 70 such that the leading end thereof is adapted to seat upon annular valve seat 72, FIG. 2 to define the closed valve position.

An O-ring 120 is disposed in an annular groove 121 formed in the outside wall of valve member 91 intermediate its ends and sealingly engages the interior wall of chamber 70 to thereby seal the part of said chamber 70 forward of or to the left of said O-ring 120, as viewed in FIGS. 2 and 3, from that portion of said chamber 70 rearwardly of or to the right of said O-ring.

A passageway 130 of stepped cross sectional configuration is formed centrally through the valve member 91, its rearward larger end opening into the cavity 105 and its forward smaller orifice 130*a* opening to the front of the conical part 112 thereof.

A port 140, FIGS. 2 and 3, is provided in the body portion 51*a* of the valve body 51 and communicates with chamber 70 closely adjacent to valve seat 72. A suitable conduit 142, having its end connected to said port 140, connects to a suitable source of cleaning detergent as indicated at D in FIG. 1.

Assuming that the valve unit 40 is connected to water source 42 whereby pressurized water is provided to valve chamber 67, the present system is operable in the manner now described to provide a mixture of water and cleaning detergent to the fabric to be cleaned.

With the on-off valve 25 closed, pressurized water is present in port 84, channel 86 and valve chamber 74, around head 102 of the coupling member, passageway 130 and orifice 130*a* of the slave valve member 91, chamber 66 and channel 80 to valve cavity 90*d* of the primary valve member 90. Said water pressure is operable on the exposed areas of said pilot valve 90 to urge the same to the left as viewed in FIG. 2 to its closed position with the head 102 of the coupling member 100 sealing the right end of passageway 130 and pressing the slave valve member 91 into pressure engagement with valve seat 72.

When the operator actuates the hand lever 30 to open valve 25, the water pressure is reduced in pipe 28, communicating channel 68, channel 80 and valve cavity 90*d*.

Maximum water pressure from said water source 42 is realized in chamber 67, port 84, channel 86 and valve chamber 74 and the resulting differential in pressure is effective on the adjoining exposed surface areas of the pilot valve member 90 to urge said pilot valve member to the right as viewed in FIG. 3 to its open valve position. Said valve movement also pulls the slave valve member 91 to the right away from valve seat 72 thereby opening valve chamber 70 to channel 68.

Pressurized water begins to flow down through channel 86 as viewed in FIG. 3 into valve chamber 74, around the head 102 of coupling member 100, into passageway 130 of the slave valve member 91 and out through orifice 130*a* into channel 68. The velocity of the water flowing into valve chamber 70 is sufficient to draw the liquid detergent from the detergent source D through port 140 and into said chamber 70 wherein it mixes with the water flowing therethrough. This mixture of water and detergent then flows through channel 68, pipe 28, on-off valve 25 and tube 20 to the head 22 whereat it is sprayed into the fabric to be cleaned.

And, with the pump 3 of the vacuum cleaner being actuated, the operator may pass the cleaning head 12 over the treated fabric and withdraw this water-detergent mixture and suspended dirt therein from said fabric.

The operator may continue to vacuum the fabric, and if he desires a "dry vacuum", he can release the valve handle 30 to permit the on-off valve 25 to return to its closed position to thus disconnect pipe 28 and valve assembly 40 from atmosphere. The pilot valve member 90 and slave valve member 91 under the influence of the pressurized water source return to their respective closed valve position as is illustrated in FIG. 2.

I claim:

1. For use with a source of water under pressure and a wet-dry vacuum cleaner having a wand for directing a mixture of water and liquid detergent to a fabric to be cleaned and a tank connected to a source of vacuum and said wand for removing said water, liquid detergent and dirt carried therein out of said fabric; and a first conduit means for providing said mixture to said wand, a source of liquid detergent, a control valve connecting to said sources of water and liquid detergent and said first conduit means comprising a valve body having first and second valve chambers formed therein in longitudinal extension with respect to each other, means connecting said first valve chamber to the source of water under pressure, second conduit means connecting said second valve chamber to the source of liquid detergent, first pilot valve means disposed in said first valve chamber, second slave valve means disposed in said second valve chamber and interconnected to said first valve means, said first conduit means being connectable to said second valve chamber and said source of water upon actuation of said second valve means to open position, said first and second valve means being in a normally closed position effective to disconnect the second valve chamber from said first conduit means, normally closed third valve means interconnected between the control valve and said first conduit means being operable to an open position effective to connect said first conduit means to atmosphere, and said first and second valve means being automatically responsive to the actuation of said third valve means to its open position to move said first and second valve means to open valve position effective to cause a mixing of water and detergent in said second chamber and dispensing of said mixture outwardly through said first conduit means to the wand.

2. A control valve as defined in claim 1 and wherein the actuation of the third valve means to open position connects the first conduit means to atmosphere to thereby cause the pressure of the source of water to automatically effect the movement of the first and second valve means to open position.

* * * * *